US010109248B2

(12) United States Patent
Li et al.

(10) Patent No.: US 10,109,248 B2
(45) Date of Patent: Oct. 23, 2018

(54) METHOD AND DEVICE FOR ADJUSTING LIQUID CRYSTAL DISPLAY

(71) Applicant: Xiaomi Inc., Beijing (CN)

(72) Inventors: Guosheng Li, Beijing (CN); Anyu Liu, Beijing (CN); Lei Yu, Beijing (CN)

(73) Assignee: Xiaomi Inc., Beijing (CN)

( * ) Notice: Subject to any disclaimer, the term of this patent is extended or adjusted under 35 U.S.C. 154(b) by 43 days.

(21) Appl. No.: 15/378,540

(22) Filed: Dec. 14, 2016

(65) Prior Publication Data

US 2017/0092213 A1 Mar. 30, 2017

Related U.S. Application Data

(63) Continuation of application No. PCT/CN2015/077825, filed on Apr. 29, 2015.

(30) Foreign Application Priority Data

Dec. 26, 2014 (CN) ..... 2014 1 0835876

(51) Int. Cl.
*G09G 3/36* (2006.01)
*G09G 3/00* (2006.01)
*G09G 3/20* (2006.01)

(52) U.S. Cl.
CPC ..... *G09G 3/3648* (2013.01); *G09G 3/006* (2013.01); *G09G 3/2003* (2013.01); (Continued)

(58) Field of Classification Search
None
See application file for complete search history.

(56) References Cited

U.S. PATENT DOCUMENTS 5,555,205 A 9/1996 Okabe
9,704,425 B2 7/2017 Zhang et al.
(Continued)

FOREIGN PATENT DOCUMENTS

CN 101051133 A 10/2007
CN 101329846 A 12/2008
(Continued)

OTHER PUBLICATIONS

International Search Report of PCT/CN2015/077825, mailed from the State Intellectual Property Office of China dated Aug. 21, 2015.
(Continued)

*Primary Examiner* — Kenneth B Lee, Jr.
(74) *Attorney, Agent, or Firm* — Finnegan, Henderson, Farabow, Garrett & Dunner LLP

(57) ABSTRACT

A method for adjusting a liquid crystal display, includes: changing a voltage applied by a source circuit of the liquid crystal display, and measuring transmittance of the liquid crystal display at different values of the applied voltage; determining, according to a corresponding relationship between the applied voltage and the measured transmittance, a critical applied voltage that corresponds to a maximum measured transmittance of the liquid crystal display; and determining an operating voltage of the source circuit according to the critical applied voltage, and adjusting the applied voltage to the operating voltage.

15 Claims, 8 Drawing Sheets

(52) U.S. Cl.
CPC ..... *G09G 3/3611* (2013.01); *G09G 3/3696* (2013.01); *G09G 2320/0242* (2013.01); *G09G 2320/0276* (2013.01); *G09G 2320/0666* (2013.01); *G09G 2320/0673* (2013.01); *G09G 2320/0693* (2013.01); *G09G 2320/08* (2013.01); *G09G 2360/145* (2013.01); *G09G 2360/16* (2013.01)

(56) References Cited

U.S. PATENT DOCUMENTS

| | | | | |
|---|---|---|---|---|
| 2006/0017678 | A1* | 1/2006 | Shiomi | G09G 3/3648 345/89 |
| 2007/0152949 | A1 | 7/2007 | Sakai | |
| 2007/0236433 | A1* | 10/2007 | Koyama | G09G 3/3611 345/87 |
| 2009/0079688 | A1 | 3/2009 | Chen et al. | |
| 2010/0033413 | A1 | 2/2010 | Song et al. | |
| 2010/0073339 | A1 | 3/2010 | Lee et al. | |
| 2012/0120124 | A1 | 5/2012 | Zhang | |
| 2012/0162532 | A1* | 6/2012 | Oniki | G09G 3/3406 348/725 |
| 2015/0243198 | A1 | 8/2015 | Zhang et al. | |

FOREIGN PATENT DOCUMENTS

| | | | |
|---|---|---|---|
| CN | 101685207 | A | 3/2010 |
| CN | 102110421 | A | 6/2011 |
| CN | 102708814 | A | 10/2012 |
| CN | 103295506 | A | 9/2013 |
| CN | 103413513 | A | 11/2013 |
| CN | 104464674 | A | 3/2015 |
| JP | S 59-99368 | A | 6/1984 |
| JP | H 6-308525 | A | 11/1994 |
| JP | 2000-105363 | A | 4/2000 |
| JP | 2000-172218 | A | 6/2000 |
| JP | 2001-281707 | A | 10/2001 |
| JP | 2003-157056 | A | 5/2003 |
| JP | 2005-338451 | A | 12/2005 |
| JP | 2006-163290 | A | 6/2006 |
| JP | 3952067 | B2 | 8/2007 |
| JP | 2007-279265 | A | 10/2007 |
| JP | 2009-294364 | A | 12/2009 |
| JP | 2011-145712 | A | 7/2011 |
| KR | 10-2006-0103527 | A | 10/2006 |
| WO | WO 2005/050614 | A1 | 6/2005 |
| WO | WO 2014/190644 | A1 | 12/2014 |

OTHER PUBLICATIONS

Extended European Search Report of European Patent Application No. 15202344.6, from the European Patent Office, dated Apr. 4, 2016.

Office Action for Russian Application No. 2015138994/28(059794), mailed from the Russian Federal Service for Intellectual Property dated Dec. 19, 2016.

* cited by examiner

METHOD AND DEVICE FOR ADJUSTING LIQUID CRYSTAL DISPLAY

CROSS-REFERENCE TO RELATED APPLICATIONS

The present application is a continuation of International Application No. PCT/CN2015/077825, filed Apr. 29, 2015, which is based upon and claims priority to Chinese Patent Application No. 201410835876.8, filed Dec. 26, 2014, the entire contents of all of which are incorporated herein by reference.

TECHNICAL FIELD

The present disclosure generally relates to the field of liquid crystal display technology and, more particularly, to a method and a device for adjusting a liquid crystal display.

BACKGROUND

As the resolution of a liquid crystal display increases, the number of pixels per inch (PPI) also increases, which may result in decreased transmittance of the liquid crystal display. Conventionally, the transmittance of the liquid crystal display may be increased by, for example, reducing regions of black matrix (BM), increasing the use of anti-reflection films, using negative liquid crystals, and changing the configuration of pixel electrodes.

SUMMARY

According to a first aspect of the present disclosure, there is provided a method for adjusting a liquid crystal display, comprising: changing a voltage applied by a source circuit of the liquid crystal display, and measuring transmittance of the liquid crystal display at different values of the applied voltage; determining, according to a corresponding relationship between the applied voltage and the measured transmittance, a critical applied voltage that corresponds to a maximum measured transmittance of the liquid crystal display; and determining an operating voltage of the source circuit according to the critical applied voltage, and adjusting the applied voltage to the operating voltage.

According to a second aspect of the present disclosure, there is provided a device for adjusting a liquid crystal display, the device comprising: a processor; and a memory for storing instructions executable by the processor; wherein the processor is configured to perform: changing a voltage applied by a source circuit of the liquid crystal display, and measuring transmittance of the liquid crystal display at different values of the applied voltage; determining, according to a corresponding relationship between the applied voltage and the measured transmittance, a critical applied voltage that corresponds to a maximum measured transmittance of the liquid crystal display; and determining an operating voltage of the source circuit according to the critical applied voltage, and adjusting the applied voltage to the operating voltage.

According to a third aspect of the present disclosure, there is provided a non-transitory computer-readable storage medium storing instructions that, when executed by a processor of a terminal, cause the terminal to perform a method for adjusting a liquid crystal display, the method comprising: changing a voltage applied by a source circuit of the liquid crystal display, and measuring transmittance of the liquid crystal display at different values of the applied voltage; determining, according to a corresponding relationship between the applied voltage and the measured transmittance, an critical applied voltage that corresponds to a maximum measured transmittance of the liquid crystal display; and determining an operating voltage of the source circuit according to the critical applied voltage, and adjusting the applied voltage to the operating voltage.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the disclosure and, together with the description, serve to explain the principles of the present disclosure.

DESCRIPTION OF THE EMBODIMENTS

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
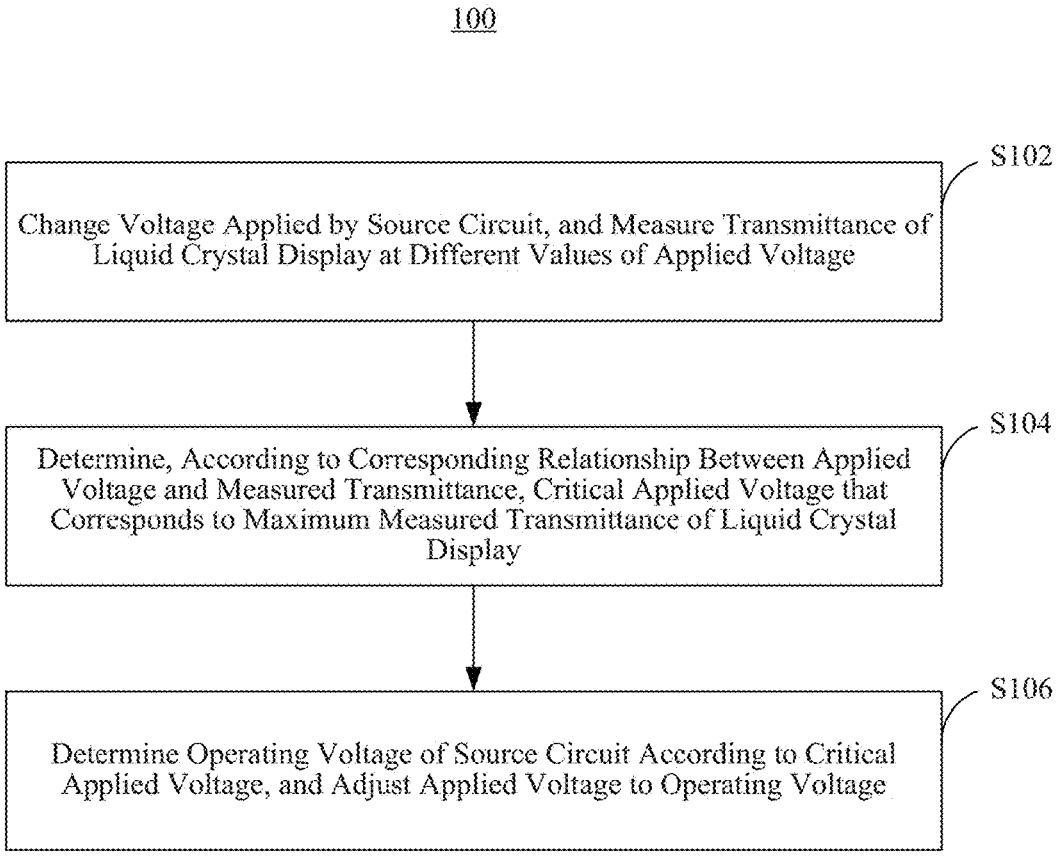
FIG. 1 is a flowchart of a method for adjusting a liquid crystal display, according to an exemplary embodiment.

FIG. 1 is a flowchart of a method 100 for adjusting a liquid crystal display, according to an exemplary embodiment. For example, the method 100 may be applied in a terminal including at least one liquid crystal display, such as a mobile phone, a tablet computer. Referring to FIG. 1, the method 100 includes the following steps.

In step S102, the terminal changes a voltage applied by a source circuit of the liquid crystal display, and measures transmittance of the liquid crystal display at different values of the applied voltage.

In exemplary embodiments, during the measurement of the transmittance, the terminal starts from a preset initial applied voltage, and increases or decreases the applied voltage stepwise using a preset initial step size. The terminal measures the transmittance of the liquid crystal display at each changed applied voltage until the measured transmittance begins to decrease.

In exemplary embodiments, step S102 may further include the following sub-steps S102*a* and S102*b*.

In sub-step S102*a*, when determining that the measured transmittance begins to decrease, the terminal decreases a current step size of the voltage change to obtain a new step size.

In sub-step S102*b*, the terminal starts from a current applied voltage, and decreases or increases the applied voltage using the new step size in a direction opposite to the last changing direction. With the new step size and new changing direction, the terminal measures the transmittance of the liquid crystal display at each changed applied voltage until the measured transmittance begins to decrease.

For example, a range of the voltage output by the source circuit is from 4 V to 6 V; the preset initial applied voltage is 4 V; and the preset initial step size is 0.3 V. The terminal increases the applied voltage from 4 V using the step size of 0.3 V, and measures the transmittance of the liquid crystal display at each increased applied voltage until the measured transmittance begins to decrease. At this point, the terminal reduces the step size to 0.1 V. The terminal then decreases the applied voltage at the step size of 0.1 V, and measures the transmittance of the liquid crystal display at each decreased applied voltage until the measured transmittance begins to decrease. The terminal then further decreases the step size to 0.05 V. The terminal subsequently increases the applied voltage at the step size of 0.05 V, and measures the transmittance of the liquid crystal display at each increased applied voltage until the measured transmittance begins to decrease. The above steps of decreasing and increasing the applied voltage are repeated until the step size is decreased to a preset value.

As another example, the range of the voltage output by the source circuit is from 4 V to 6 V; the preset initial applied voltage is 6 V; and the preset initial step size is 0.3 V. The terminal decreases the applied voltage from 6 V using the step size of 0.3 V, and measures the transmittance of the liquid crystal display at each decreased applied voltage until the measured transmittance begins to decrease. At this point, the terminal reduces the step size to 0.1 V. The terminal then increases the applied voltage using the step size of 0.1 V, and measures the transmittance of the liquid crystal display at each increased applied voltage until the measured transmittance begins to decrease. The terminal then further decreases the step size to 0.05 V. The terminal subsequently decreases the applied voltage using the step size of 0.05 V, and measures the transmittance of the liquid crystal display at each decreased applied voltage until the measured transmittance begins to decrease. The above steps of decreasing and increasing the applied voltage are repeated until the step size is decreased to a preset value.

In step S104, the terminal determines a critical applied voltage corresponding to a maximum transmittance of the liquid crystal display, according to a corresponding relationship between the applied voltage and the measured transmittance.

Figure 2:
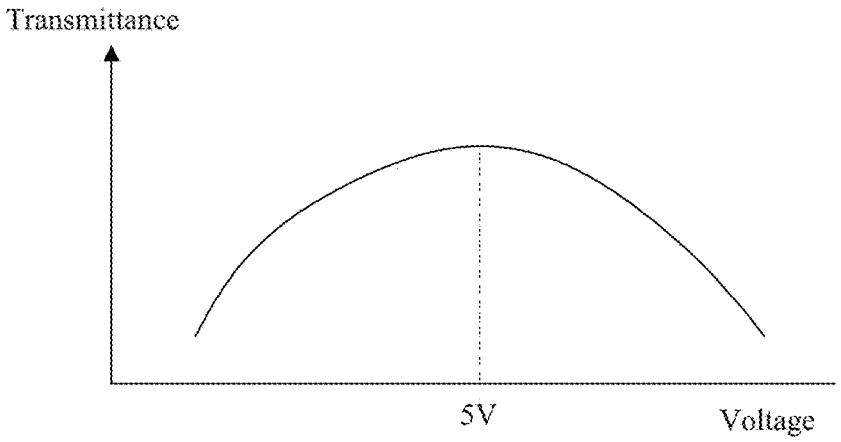
FIG. 2 is a schematic diagram illustrating a corresponding relationship between a voltage applied on a liquid crystal display and transmittance of the liquid crystal display, according to an exemplary embodiment.

The transmittance of the liquid crystal display decreases from the maximum measured transmittance when the applied voltage is higher or lower than the critical applied voltage. FIG. 2 is an exemplary schematic diagram illustrating a corresponding relationship between the applied voltage and the transmittance. Referring to FIG. 2, for example, the critical applied voltage is 5 V, at which the transmittance of the liquid crystal display reaches a maximum value. When the applied voltage is higher or lower than 5 V, the transmittance decreases from the maximum value. In exemplary embodiments, each liquid crystal display may have a different critical applied voltage, and steps S102 and S104 may be performed for each liquid crystal display to obtain the respective critical applied voltage.

Referring back to FIG. 1, in step S106, the terminal device determines an operating voltage of the source circuit according to the critical applied voltage, and adjusts the applied voltage of the source circuit to the operating voltage.

In exemplary embodiments, the terminal device takes the critical applied voltage as a center, and determines the operating voltage of the source circuit in a preset range. For example, if the critical applied voltage is 5.2 V, the terminal takes 5.2 V as the center, and determines the operating voltage in a preset range from 4.8 V to 5.6 V. The terminal may determine the operating voltage to be 5 V and adjust the applied voltage to 5 V.

By adjusting the operating voltage of the source circuit to the critical applied voltage of the liquid crystal display, the method 100 can increase the transmittance of the liquid crystal display, and thereby increase the brightness of the liquid crystal display without changing the structure of the liquid crystal display.

Figure 3:
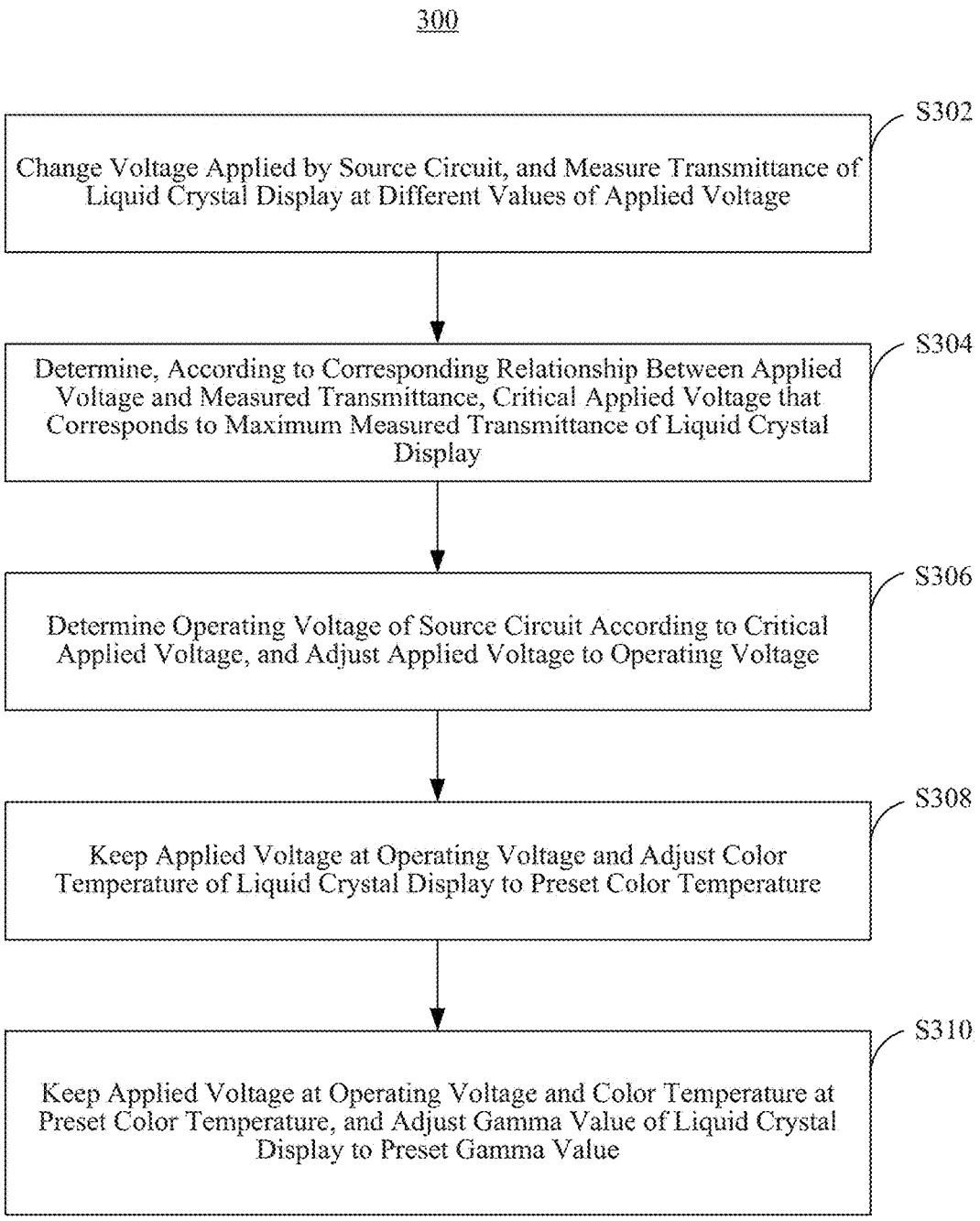
FIG. 3 is a flowchart of a method for adjusting a liquid crystal display, according to an exemplary embodiment.

FIG. 3 is a flowchart of a method 300 for adjusting a liquid crystal display, according to an exemplary embodiment. For example, the method 300 may be applied in a terminal including at least one liquid crystal display, such as a mobile phone, a tablet computer. Referring to FIG. 3, the method 300 includes the following steps.

In step S302, the terminal changes a voltage applied by a source circuit of the liquid crystal display, and measures transmittance of the liquid crystal display at different values of the applied voltage.

In step S304, the terminal determines a critical applied voltage corresponding to a maximum measured transmittance of the liquid crystal display, according to a corresponding relationship between the applied voltage and the measured transmittance.

In step S306, the terminal determines an operating voltage of the source circuit according to the critical applied voltage, and adjusts the applied voltage of the source circuit to the operating voltage.

Steps S302-S306 are similar to steps S102-S106 (FIG. 1), respectively.

In step S308, the terminal keeps the applied voltage at the operating voltage, and adjusts a color temperature of the liquid crystal display to a preset color temperature.

For example, the liquid crystal display has a preset color temperature of 6500 K. While keeping the applied voltage at the operating voltage, the terminal measures the color temperature of the liquid crystal display. The terminal adjusts the voltages associated with the red, green, and blue colors (RGB) until the measured color temperature reaches 6500 K.

In step S310, the terminal keeps the applied voltage at the operating voltage and the color temperature at the preset color temperature, and adjusts a gamma value of the liquid crystal display to a preset gamma value.

For example, the liquid crystal display may have a preset gamma value of 2.2. While keeping the applied voltage at the operating voltage and the color temperature at the preset color temperature, the terminal adjusts each grayscale voltage of the liquid crystal display until the gamma value is 2.2.

By adjusting the color temperature and the gamma value to the preset values of the liquid crystal display, the method 300 improves both the brightness of the liquid crystal display and the display quality for images.

Figure 4:
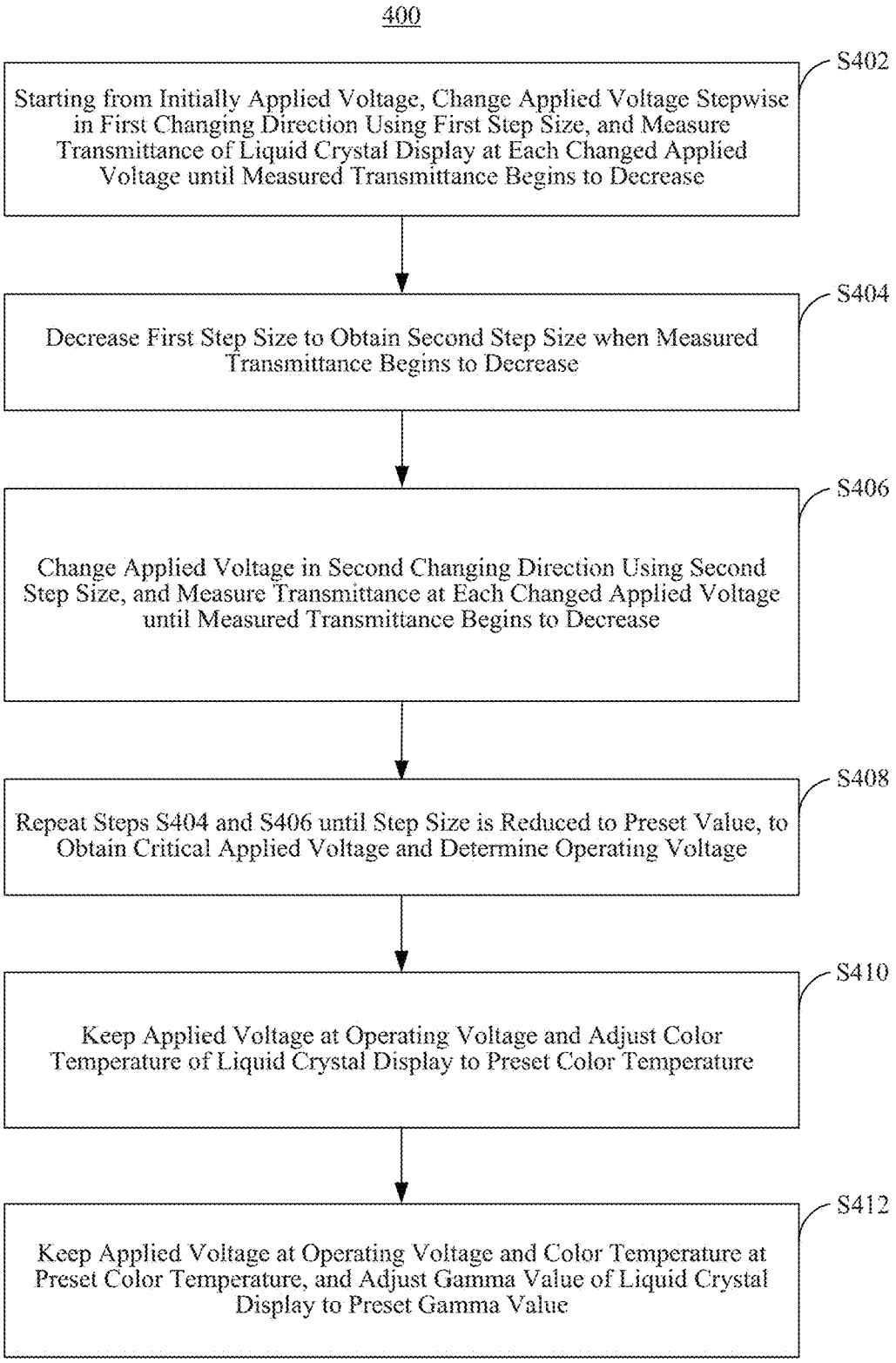
FIG. 4 is a flowchart of a method for adjusting a liquid crystal display, according to an exemplary embodiment.

FIG. 4 is a flowchart of a method 400 for adjusting a liquid crystal display, according to an exemplary embodiment. For example, the method 400 may be applied in a terminal including at least one liquid crystal display, such as a mobile phone, a tablet computer, etc. Referring to FIG. 4, the method 400 includes the following steps.

In step S402, the terminal, starting from an initially applied voltage, changes the applied voltage stepwise in a first changing direction using a first step size, and measures transmittance of the liquid crystal display at each changed applied voltage until the measured transmittance begins to decrease.

In step S404, when the measured transmittance begins to decrease, the terminal decreases the first step size to obtain a second step size.

In step S406, the terminal uses the second step size to change the applied voltage in a second changing direction opposite to the first changing direction, and measures the transmittance of the liquid crystal display at each changed applied voltage until the measured transmittance begins to decrease.

In step S408, the terminal repeats steps S404 and S406 until the step size is decreased to a preset value to obtain a critical applied voltage that corresponds to a maximum measured transmittance of the liquid crystal display, and to determine an operating voltage according to the critical applied voltage.

In step S410, the terminal keeps the applied voltage at the operating voltage, and adjusts color temperature of the liquid crystal display to a preset color temperature.

In step S412, the terminal keeps the applied voltage at the operating voltage and the color temperature at the preset color temperature, and adjusts a gamma value of the liquid crystal display to a preset gamma value.

Figure 5:
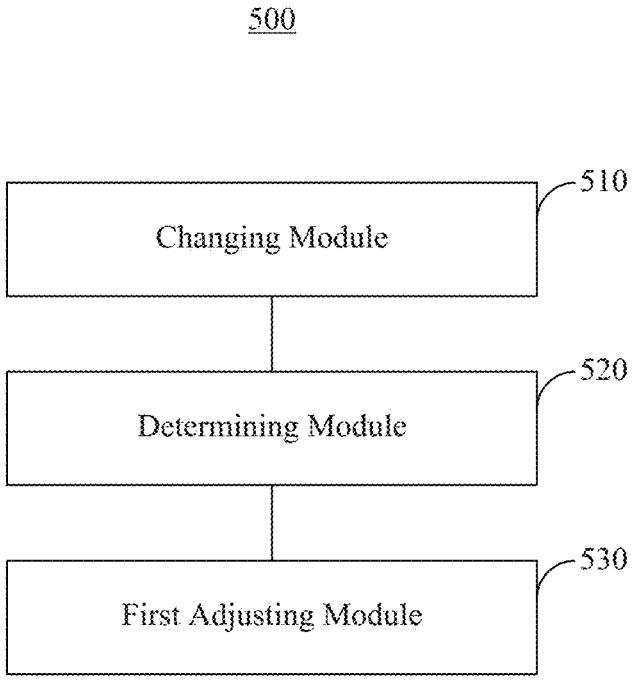
FIG. 5 is a block diagram of a device for adjusting a liquid crystal display, according to an exemplary embodiment.

FIG. 5 is a block diagram of a device 500 for adjusting a liquid crystal display, according to an exemplary embodiment. For example, the device 500 may be a part or whole of a terminal, such as a mobile phone, a tablet computer, and the terminal may include at least one liquid crystal display. Referring to FIG. 5, the device 500 includes a changing module 510, a determining module 520, and a first adjusting module 530.

The changing module 510 is configured to change a voltage applied by a source circuit of the liquid crystal display, and measure transmittance of the liquid crystal display at different values of the applied voltage.

The determining module 520 is configured to determine a critical applied voltage corresponding to a maximum measured transmittance of the liquid crystal display, according to a corresponding relationship between the applied voltage and the measured transmittance. When the applied voltage is higher or lower than the critical applied voltage, the transmittance of the liquid crystal display decreases from the maximum measured transmittance.

The first adjusting module 530 is configured to determine an operating voltage of the source circuit according to the critical applied voltage, and adjust the applied voltage to the operating voltage.

Figure 6:
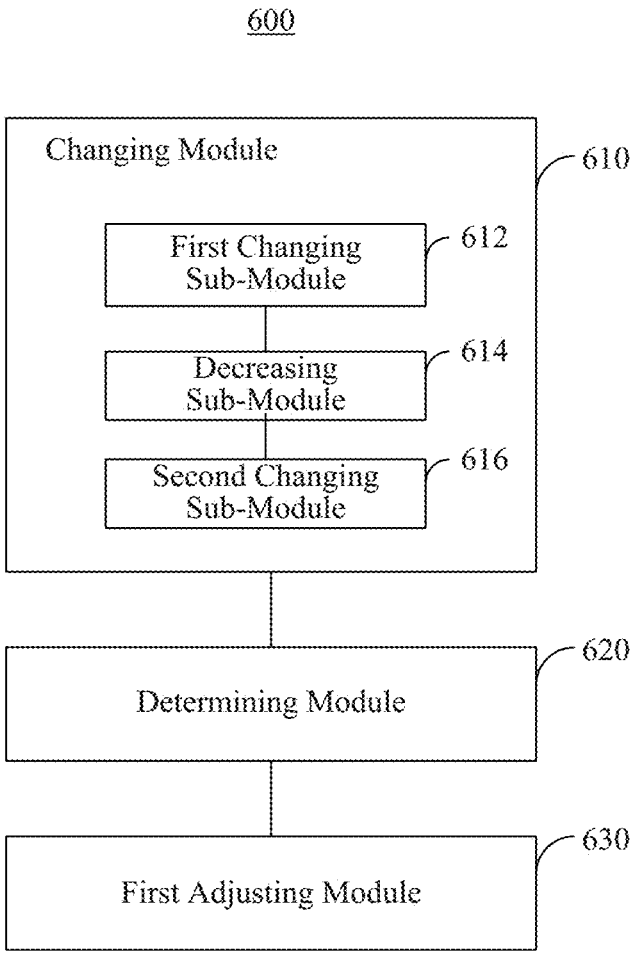
FIG. 6 is a block diagram of a device for adjusting a liquid crystal display, according to an exemplary embodiment.

FIG. 6 is a block diagram of a device 600 for adjusting a liquid crystal display, according to an exemplary embodiment. For example, the device 600 may be a part or whole of a terminal, such as a mobile phone, a tablet computer, and the terminal may include at least one liquid crystal display. Referring to FIG. 6, the device 600 includes a changing module 610, a determining module 620, and a first adjusting module 630, similar to the changing module 510, the determining module 520, and the first adjusting module 530 (FIG. 5), respectively.

In exemplary embodiments, referring to FIG. 6, the changing module 610 further includes one or more of a first changing sub-module 612, a decreasing sub-module 614, and a second changing sub-module 616.

The first changing sub-module 612 is configured to, staring from a preset initially applied voltage, increase or decrease the applied voltage stepwise in a first changing direction using a first step size, and measure the transmittance of the liquid crystal display at each changed applied voltage until the measured transmittance begins to decrease.

The decreasing sub-module 614 is configured to decrease the first step size to obtain a second step size when the measured transmittance begins to decrease.

The second changing sub-module 616 is configured to decrease or increase the applied voltage in a second changing direction using the second step size, and measure the transmittance at each changed applied voltage until the measured transmittance begins to decrease. The second changing direction is opposite to the first changing direction.

Figure 7:
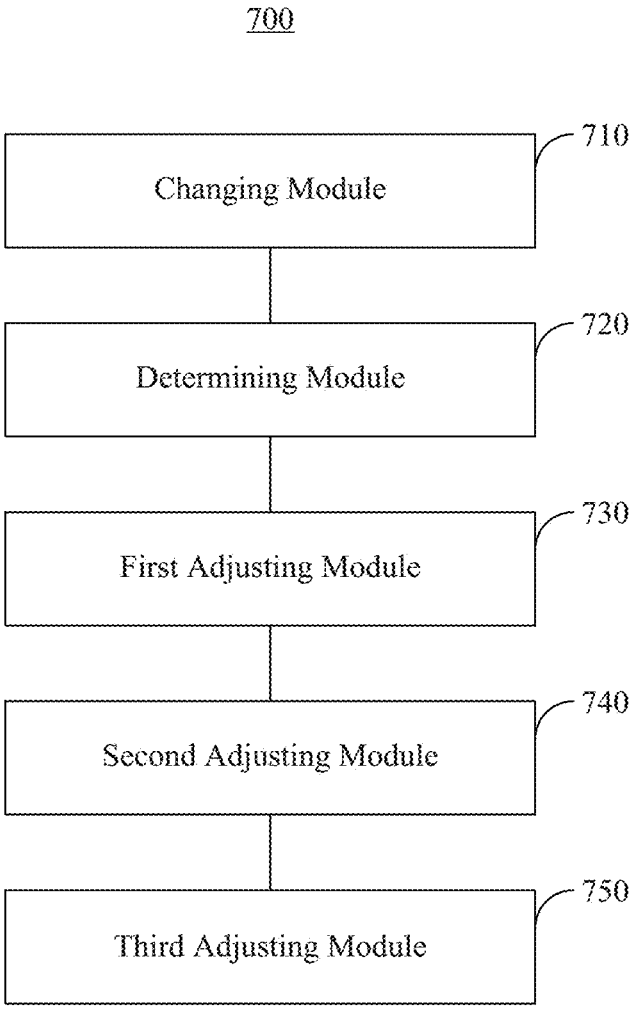
FIG. 7 is a block diagram of a device for adjusting a liquid crystal display, according to an exemplary embodiment.

FIG. 7 is a block diagram of a device 700 for adjusting a liquid crystal display, according to an exemplary embodiment. For example, the device 700 may be a part or whole of a terminal, such as a mobile phone, a tablet computer, and the terminal may include at least one liquid crystal display. Referring to FIG. 7, the device 700 includes a changing module 710, a determining module 720, and a first adjusting module 730, similar to the changing module 510, the determining module 520, and the first adjusting module 530 (FIG. 5), respectively.

In exemplary embodiments, referring to FIG. 7, the device 700 further includes one or more of a second adjusting module 740 and a third adjusting module 750.

The second adjusting module is configured to adjust a color temperature of the liquid crystal display to a preset color temperature while the applied voltage of the source circuit is kept at the operating voltage.

The third adjusting module 750 is configured to adjust a gamma value of the liquid crystal display to a preset gamma value while the applied voltage of the source circuit is kept at the operating voltage and the color temperature is kept at the preset color temperature.

Figure 8:
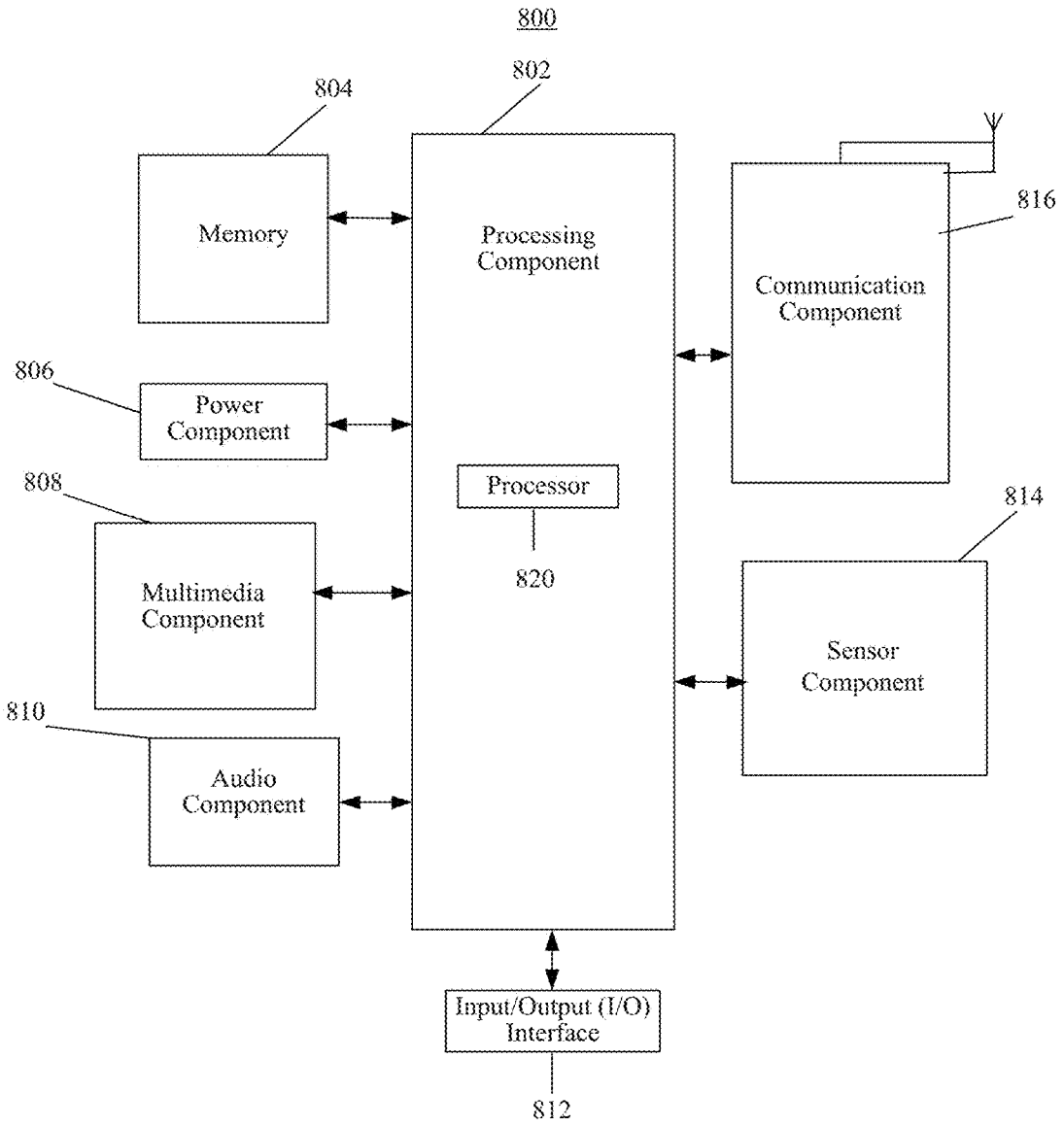
FIG. 8 is a block diagram of a device for adjusting a liquid crystal display, according to an exemplary embodiment.

FIG. 8 is a block diagram of a device 800 for adjusting a liquid crystal display, according to an exemplary embodiment. For example, the device 800 may be a mobile phone, a computer, a digital broadcast terminal, a messaging device, a gaming console, a tablet, a medical device, exercise equipment, a personal digital assistant (PDA), and the like.

Referring to FIG. 8, the device 800 may include one or more of the following components: a processing component 802, a memory 804, a power component 806, a multimedia component 808, an audio component 810, an input/output (I/O) interface 812, a sensor component 814, and a communication component 816.

The processing component 802 typically controls overall operations of the device 800, such as the operations associated with display, telephone calls, data communications, camera operations, and recording operations. The processing component 802 may include one or more processors 820 to execute instructions to perform all or part of the steps in the above-described methods. Moreover, the processing component 802 may include one or more modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the device 800. Examples of such data include instructions for any applications or methods operated on the device 800, contact data, phonebook data, messages, pictures, videos, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the device 800. The power component 806 may include a power management system, one or more power sources, and other components associated with the generation, management, and distribution of power in the device 800.

The multimedia component 808 includes a screen providing an output interface between the device 800 and the user. The screen includes one or more liquid crystal displays. The screen may also include a touch panel. If the screen includes the touch panel, the screen may be implemented as a touch screen to receive input signals from the user. The touch panel includes one or more touch sensors to sense touches, slips, and gestures on the touch panel. The touch sensors may not only sense a boundary of a touch or slip action, but also sense a period of time and a pressure associated with the touch or slip action. In some embodiments, the multimedia component 808 includes a front camera and/or a rear camera. The front camera and/or the rear camera may receive an external multimedia datum while the device 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone configured to receive an external audio signal when the device 800 is in an operation mode, such as a call mode, a recording mode, and a voice identification mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, buttons, and the like. The buttons may include, but not limited to, a home button, a volume button, a starting button, and a locking button.

The sensor component 814 includes one or more sensors to provide status assessments of various aspects of the device 800. For instance, the sensor component 814 may detect an open/closed status of the device 800, relative positioning of components, e.g., the display and the keyboard, of the device 800, a change in position of the device 800 or a component of the device 800, a presence or absence of user contact with the device 800, an orientation or an acceleration/deceleration of the device 800, and a change in temperature of the device 800. The sensor component 814 may include a proximity sensor configured to detect the presence of nearby objects without any physical contact. The sensor component 814 may also include a light sensor, such as a CMOS or CCD image sensor, for use in imaging applications. In some embodiments, the sensor component 814 may also include an accelerometer sensor, a gyroscope sensor, a magnetic sensor, a pressure sensor, or a temperature sensor.

The communication component 816 is configured to facilitate communication, wired or wirelessly, between the device 800 and other devices. The device 800 may access a wireless network based on a communication standard, such as WiFi, 2G, 3G, or a combination thereof. In one exemplary embodiment, the communication component 816 receives a broadcast signal or broadcast associated information from an external broadcast management system via a broadcast channel In one exemplary embodiment, the communication component 816 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 800 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above-described method.

In exemplary embodiments, there is also provided a non-transitory computer-readable storage medium including instructions, such as included in the memory 804, executable by the processor 820 in the device 800, for performing the above-described method. For example, the non-transitory computer-readable storage medium may be a ROM, a random access memory (RAM), a CD-ROM, a magnetic tape, a floppy disc, an optical data storage device, and the like.

One of ordinary skill in the art will understand that the above-described modules can each be implemented by hardware, or software, or a combination of hardware and software. One of ordinary skill in the art will also understand that multiple ones of the above-described modules may be combined as one module, and each of the above-described modules may be further divided into a plurality of sub-modules.

Other embodiments of the present disclosure will be apparent to those skilled in the art from consideration of the specification and practice of the present disclosure. This application is intended to cover any variations, uses, or adaptations of the present disclosure following the general principles thereof and including such departures from the present disclosure as coming within known or customary practice in the art. It is intended that the specification and examples be considered as exemplary only, with a true scope and spirit of the invention being indicated by the following claims.

It should be understood that the present disclosure is not limited to the exact constructions that are described above and illustrated in the accompanying drawings, and that various modifications and changes may be made without departing from the scope thereof. It is intended that the scope of the present disclosure only be limited by the appended claims.

What is claimed is:

1. A method for adjusting a liquid crystal display, comprising:

changing a voltage applied by a source circuit of the liquid crystal display, and measuring transmittance of the liquid crystal display at different values of the applied voltage;

determining, according to a corresponding relationship between the applied voltage and the measured transmittance, a critical applied voltage that corresponds to a maximum measured transmittance of the liquid crystal display; and determining an operating voltage of the source circuit according to the critical applied voltage, and adjusting the applied voltage to the operating voltage, wherein the changing of the applied voltage and the measuring of the transmittance of the liquid crystal display comprises:

changing, starting from a preset applied voltage, the applied voltage stepwise in a first changing direction using a first step size; and measuring the transmittance of the liquid crystal display at each changed applied voltage until the measured transmittance begins to decrease.

2. The method according to claim 1, further comprising:

when the measured transmittance begins to decrease, decreasing the first step size to obtain a second step size;

changing the applied voltage in a second changing direction using the second step size, the second changing direction being opposite to the first changing direction; and measuring the transmittance of the liquid crystal display at each changed applied voltage until the measured transmittance begins to decrease.

3. The method according to claim 1, wherein the measured transmittance decreases from the maximum measured transmittance when the applied voltage is higher or lower than the critical applied voltage.

4. The method according to claim 1, further comprising:

keeping the applied voltage at the operating voltage and adjusting a color temperature of the liquid crystal display to a preset color temperature.

5. The method according to claim 4, further comprising:

keeping the applied voltage at the operating voltage and the color temperature at the preset color temperature, and adjusting a gamma value of the liquid crystal display to a preset gamma value.

6. A device for adjusting a liquid crystal display, the device comprising:

a processor; and a memory for storing instructions executable by the processor;

wherein the processor is configured to perform:

changing a voltage applied by a source circuit of the liquid crystal display, and measuring transmittance of the liquid crystal display at different values of the applied voltage;

determining, according to a corresponding relationship between the applied voltage and the measured transmittance, a critical applied voltage that corresponds to a maximum measured transmittance of the liquid crystal display; and determining an operating voltage of the source circuit according to the critical applied voltage, and adjusting the applied voltage to the operating voltage, wherein in changing the applied voltage and measuring the transmittance of the liquid crystal display, the processor is further configured to perform:

changing, starting from a preset applied voltage, the applied voltage stepwise in a first changing direction using a first step size; and measuring the transmittance of the liquid crystal display at each changed applied voltage until the measured transmittance begins to decrease.

7. The device according to claim 6, wherein the processor is further configured to perform:

when the measured transmittance begins to decrease, decreasing the first step size to obtain a second step size;

changing the applied voltage in a second changing direction using the second step size, the second changing direction being opposite to the first changing direction; and measuring the transmittance of the liquid crystal display at each changed applied voltage until the measured transmittance begins to decrease.

8. The device according to claim 6, wherein the measured transmittance decreases from the maximum measured transmittance when the applied voltage is higher or lower than the critical applied voltage.

9. The device according to claim 6, wherein the processor is further configured to perform:

keeping the applied voltage at the operating voltage and adjusting a color temperature of the liquid crystal display to a preset color temperature.

10. The device according to claim 9, wherein the processor is further configured to perform:

keeping the applied voltage at the operating voltage and the color temperature at the preset color temperature, and adjusting a gamma value of the liquid crystal display to a preset gamma value.

11. A non-transitory computer-readable storage medium storing instructions that, when executed by a processor of a terminal, cause the terminal to perform a method for adjusting a liquid crystal display, the method comprising:

changing a voltage applied by a source circuit of the liquid crystal display, and measuring transmittance of the liquid crystal display at different values of the applied voltage;

determining, according to a corresponding relationship between the applied voltage and the measured transmittance, an critical applied voltage that corresponds to a maximum measured transmittance of the liquid crystal display; and determining an operating voltage of the source circuit according to the critical applied voltage, and adjusting the applied voltage to the operating voltage, wherein the changing of the applied voltage and the measuring of the transmittance of the liquid crystal display comprises:

changing, starting from a preset applied voltage, the applied voltage stepwise in a first changing direction using a first step size; and measuring the transmittance of the liquid crystal display at each changed applied voltage until the measured transmittance begins to decrease.

12. The medium according to claim 11, wherein the method further comprises:

decreasing the first step size to obtain a second step size when the measured transmittance begins to decrease;

changing the applied voltage in a second changing direction using the second step size, the second changing direction being opposite to the first changing direction; and measuring the transmittance of the liquid crystal display at each changed applied voltage until the measured transmittance begins to decrease.

13. The medium according to claim 11, wherein the measured transmittance decreases from the maximum measured transmittance when the applied voltage is higher or lower than the critical applied voltage.

14. The medium according to claim 11, wherein the method further comprises:

keeping the applied voltage at the operating voltage and adjusting a color temperature of the liquid crystal display to a preset color temperature.

15. The medium according to claim 14, wherein the method further comprises:

keeping the applied voltage at the operating voltage and the color temperature at the preset color temperature, and adjusting a gamma value of the liquid crystal display to a preset gamma value.

* * * * *